United States Patent [19]

Pendleton

[11] Patent Number: 4,654,016

[45] Date of Patent: Mar. 31, 1987

[54] BUOYANT VEST AND METHOD OF MAKING THE SAME

[75] Inventor: Donald L. Pendleton, Cincinnati, Ohio

[73] Assignee: The Safegard Corporation, Covington, Ky.

[21] Appl. No.: 814,728

[22] Filed: Dec. 30, 1985

[51] Int. Cl.[4] ..... B63C 9/08

[52] U.S. Cl. ..... 441/116; 441/118

[58] Field of Search ..... 441/112, 113, 117, 118, 441/114, 115, 116

[56] References Cited

U.S. PATENT DOCUMENTS

| | | | |
|---|---|---|---|
| 1,618,347 | 2/1927 | McSherry . | |
| 2,374,580 | 4/1945 | Brown | 441/118 |
| 3,247,531 | 4/1966 | Baker . | |
| 3,360,813 | 1/1968 | Baker . | |
| 3,366,984 | 2/1968 | LeBlanc . | |
| 3,371,363 | 3/1968 | LeBlanc . | |
| 3,383,722 | 5/1968 | LeBlanc . | |
| 3,988,795 | 2/1976 | Roberetson . | |
| 4,371,353 | 2/1983 | Hume | 441/117 |
| 4,380,441 | 4/1983 | Harr et al. . | |

FOREIGN PATENT DOCUMENTS

| | | | |
|---|---|---|---|
| 1122997 | 8/1968 | United Kingdom | 441/118 |

*Primary Examiner*—Sherman D. Basinger
*Assistant Examiner*—Thomas J. Brahan
*Attorney, Agent, or Firm*—Wood, Herron & Evans

[57] ABSTRACT

A buoyant vest in which two elongated foam members are encased in a single sheath of coated fabric to form the vest. A single strap secures the vest around the body of the wearer.

4 Claims, 8 Drawing Figures

BUOYANT VEST AND METHOD OF MAKING THE SAME

This invention relates to a Type II buoyant vest. For the past twenty or thirty years, the Type II vests have been manufactured in accordance with the specifications of the United States Coast Guard. The vest has consisted of three sections of flotation material (kapok or foam). The flotation material is encased in a coated fabric usually formed from two pieces of the fabric. The resultant structure consists of two elongated members adapted to extend down the chest of the wearer and a cross member adapted to be positioned behind the head of the wearer.

The joining of the cross member to the elongated members by means of the fabric creates a rather floppy connection. The elongated members across the chest of the wearer are held together when the vest is worn by tying an upper tie and by buckling a strap around the body of the wearer. When worn in water, the cross member presents corners of flotation material which have a tendency to resist the wearer's turning over from a face-down to a face-up position.

An objective of the present invention has been to provide a buoyant vest which is improved in at least the following respects:

(a) The vest is significantly less costly to manufacture.

(b) The vest provides firm support for the head of the wearer.

(c) The vest has the capability of turning a face-down wearer into a face-up position.

(d) The configuration of the vest makes it easier to stuff into storage.

The objective of the invention is attained by providing two identical elongated flotation members and a single sheath of coated fabric enclosing the flotation members. The fabric can be uncoated. The flotation members have facing recesses at their upper ends and are joined together by the sheath of fabric in such a way that the recesses in the upper ends of the elongated members together form an opening which receives the neck of the wearer. A single strap is provided for attaching the vest to the body of the wearer.

When the vest is in place, strapped around the wearer, the upper portion of the flotation members cup the back of the head of the wearer and hold the head firmly in place.

The flotation members are curved at their upper ends so that when the upper ends are brought together, they create a curved bullet-like appearance. The advantages of the curved configuration at the upper end of the jacket are two-fold: the projecting corners which would tend to resist the rotating, in the water, from a face-down to a face-up position are eliminated. Further, the bullet-like configuration makes it easier to thrust the vest, among other vests, into a storage chest or locker.

The vest may be manufactured at significantly less cost than the conventional Type II vest. The two elongated flotation members are substantially identical and hence may be cut from a single die. The single sheath within which the flotation members are encased requires significantly less stitching than does the prior art structure. There is less waste of fabric. Only a single strap is required to secure the vest to the wearer. When all of these factors are combined, the result is a product which is about 16% less expensive than the prior product.

The several features and objectives of the present invention will become more readily apparent from the following detailed description taken in conjunction with the accompanying drawings in which.

Figure 1:
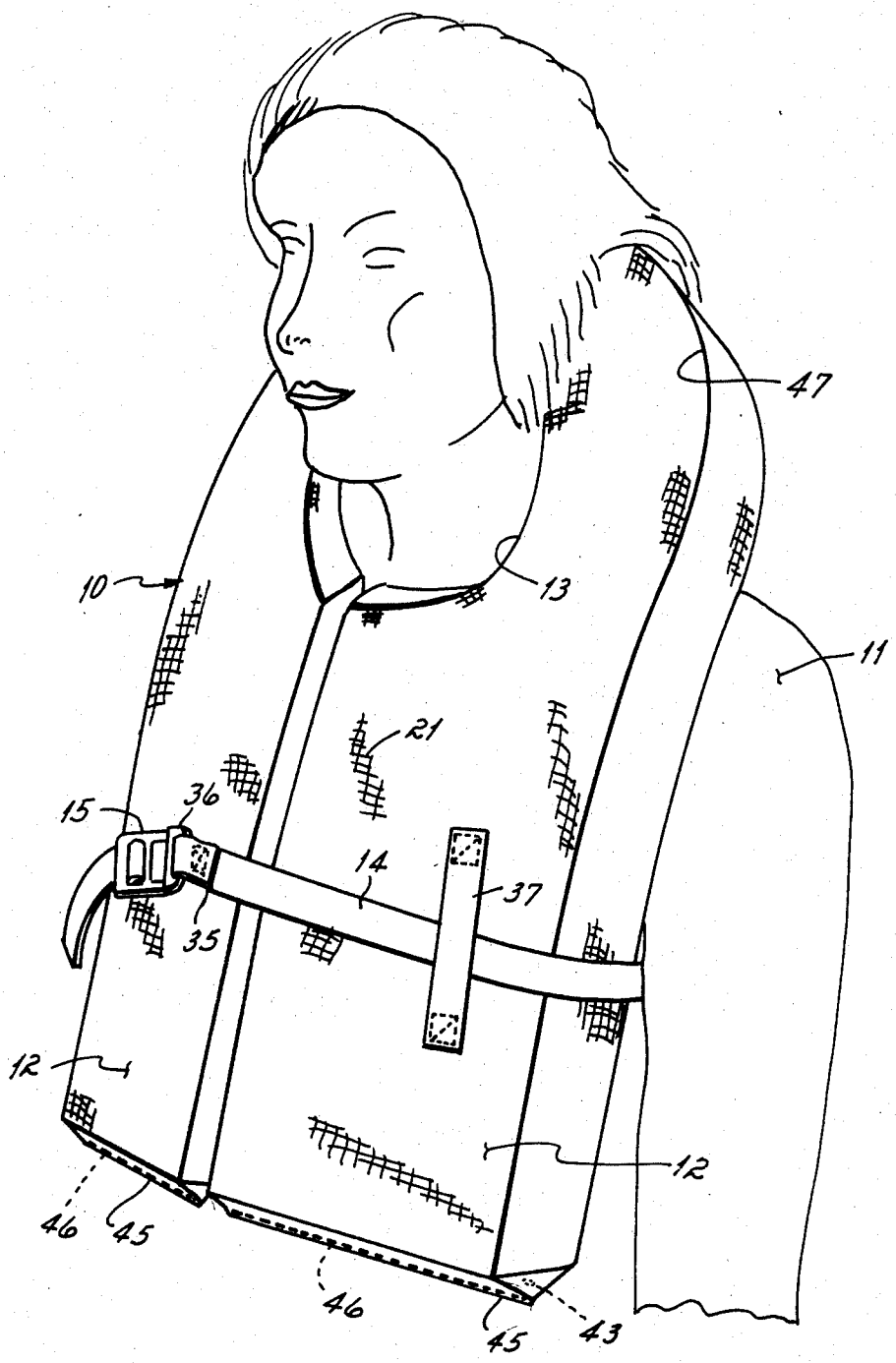
FIG. 1 is a perspective view of the invention applied to a wearer.

Referring to FIG. 1, the vest indicated at 10 is applied to a human body indicated at 11. The vest consists of two elongated members 12 creating between them an opening 13 which receives the neck of the wearer 11. Thus, the upper end of the vest is secured to the wearer by spreading apart the two elongated members 12 and thereafter bringing them together in the attitude illustrated in FIG. 1. A belt 14 wraps around the body of the wearer and has a buckle-type clasp 15 for adjustably securing the lower portion of the vest to the body of the wearer 11.

Figure 7:
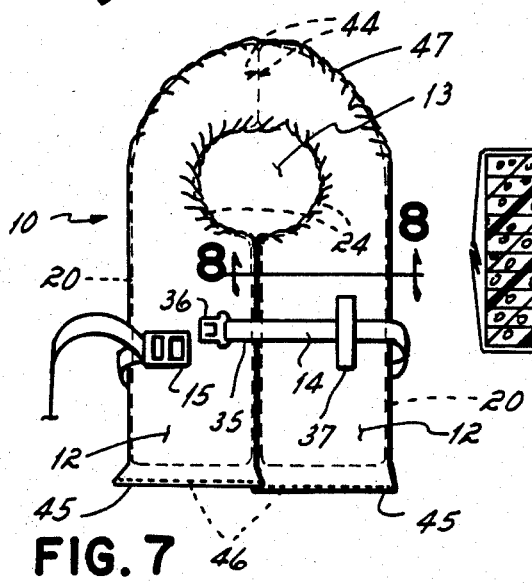
Figure 8:
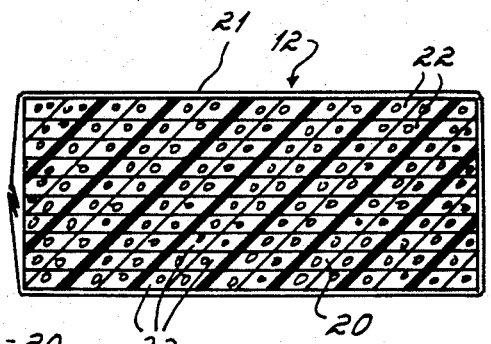
FIG. 8 is a cross-sectional view taken along lines 8—8 of FIG. 7.

As shown in FIGS. 7 and 8, the vest is formed of two elongated flotation members 20 which are encased in a coated fabric 21. Each flotation member may be a solid block or may be formed from a plurality of flat polyethylene foam sheets 22 as shown in FIG. 8. Each member 20 uses about ten sheets, each of which is about one-fourth inch thick.

Figure 2:
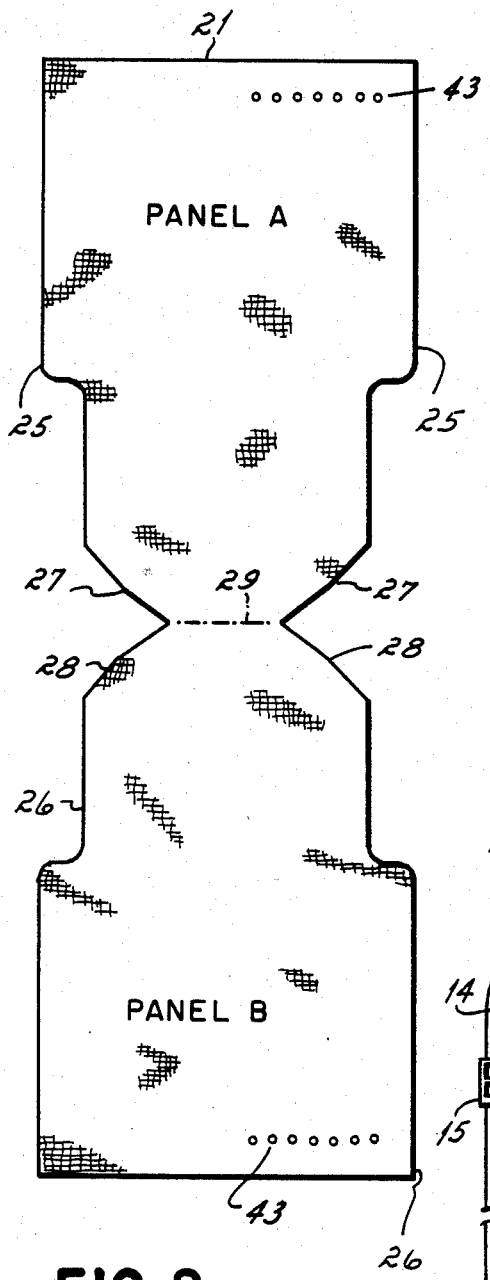
FIGS. 2 to 7 are plan views of materials from which the buoyant vest of the invention is made, the views illustrating the sequence of steps followed in the manufacture of the product.
Figure 3:
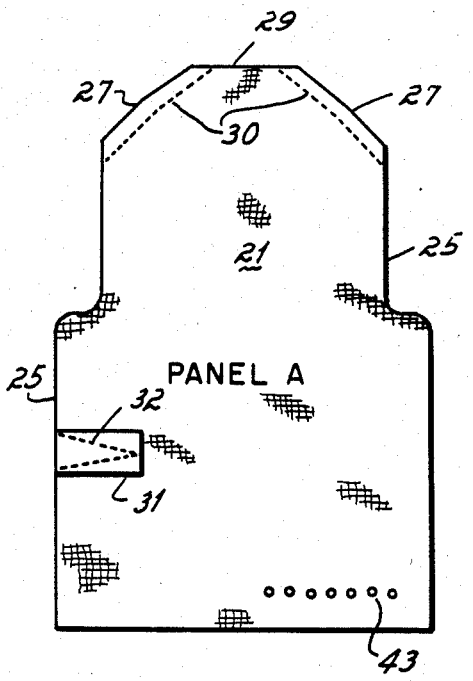
Figure 4:
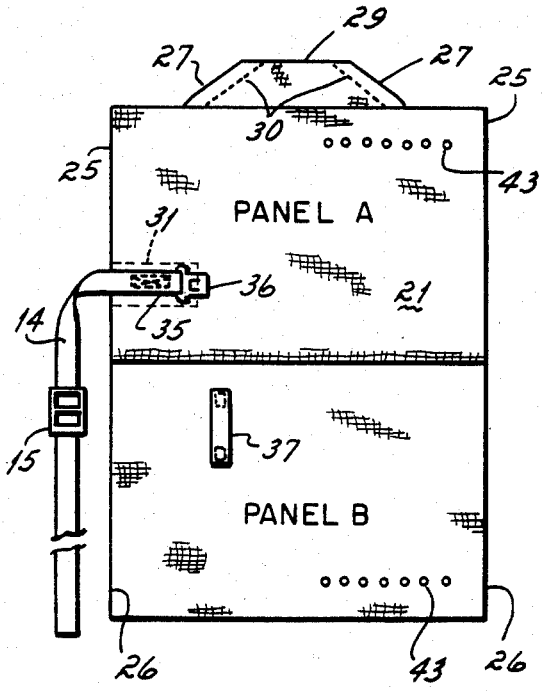
Figure 5:
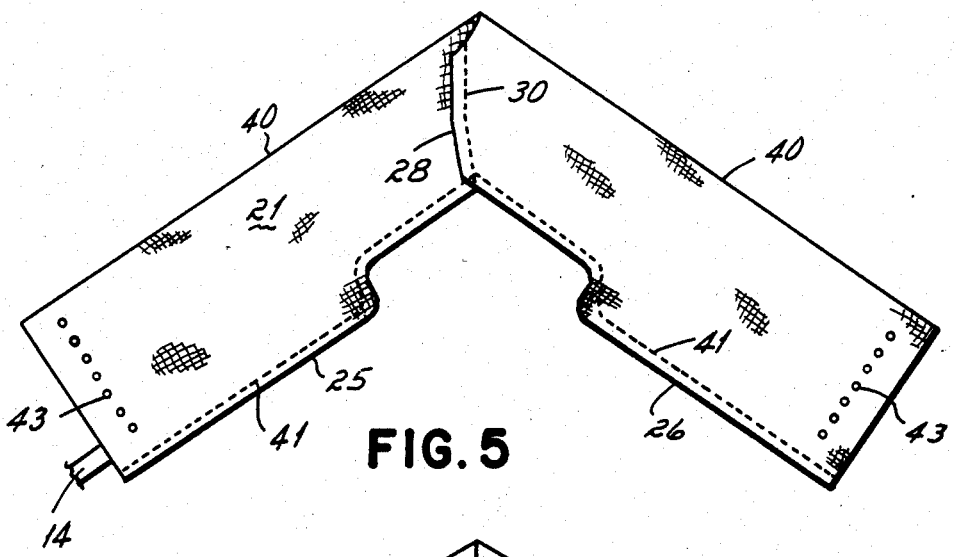

The product is formed as illustrated in the steps depicted in FIGS. 2 to 7. In FIG. 2, the coated fabric 21 is cut to the configuration illustrated. The fabric has an A panel and a B panel. The A panel has longitudinal edges 25 and the B panel has longitudinal edges 26. The panels have diagonal edges 27 and 28, respectively, thereby presenting an hourglass configuration.

The panels meet along a transverse line 29. In step 2, the fabric is folded upon itsself along the transverse line 29. Diagonal edges 27 are stitched to diagonal edges 28 along the lines 30. A reinforcing piece of coated fabric 31 is stitched to the inside of the A panel along lines 32. In the next step, illustrated in FIG. 4 which shows panel A folded up upon itself to expose the lower half of panel B and the inside of the lower half of panel A, one end 35 of the belt 14 together with buckle 36 is stitched to the opposite side of the reinforced portion 31 on the outside of panel A. A belt strap 37 is stitched to the outside of panel B so as to be horizontally aligned with the belt when the jacket is worn.

Figure 6:
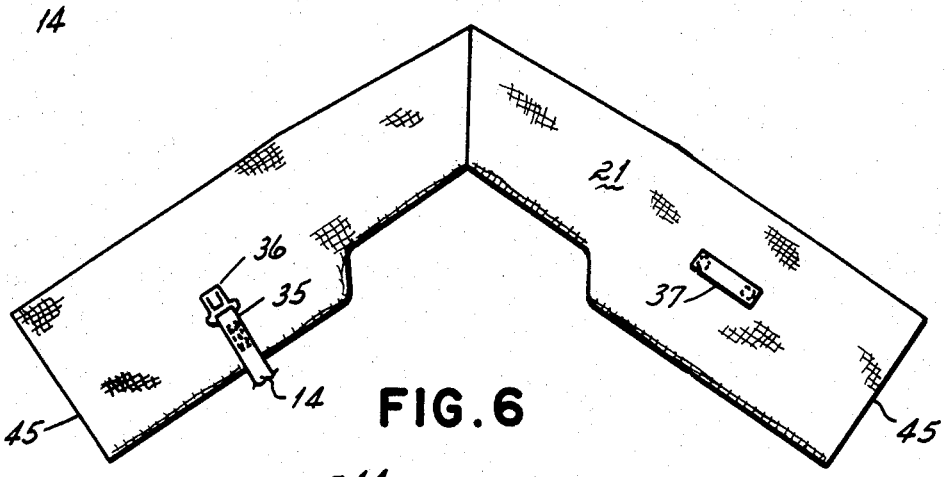

Each panel A and B is then folded upon itself along a longitudinal crease 40 to bring the longitudinal edges 25 of panel A together and to bring the longitudinal edges 26 of panel B together. The longitudinal edges are then stitched as at 41, thereby forming a tubular sheath which lies in a V shape. The sheath is a generally V configuration illustrated in FIG. 5 with the stitching visible on the exposed raw edges. The tubular sheath is turned inside out to bring the raw edges into the inside of the tube and to bring the belt and strap to the outside of the tube. The sheath does not necessarily have to be turned inside out. If this step is eliminated, the raw edges should be covered or rolled and top-stitched. The article in that stage appears as illustrated in FIG. 6. The elongated flotation members 20, with their recesses 24 facing each other, are stuffed into the tubular sheath.

The elongated members have surfaces 44 at their upper ends which abut each other when the members are inserted fully into the tubular sheath as illustrated in FIG. 7. The free edges 45 are thereafter closed by stitching them along lines 46 to complete the formation of the vest. Holes 43 are provided near stitch lines 46 to permit the drainage of water that could become entrapped within the fabric. These holes are only required when a coated fabric is used. The fabric fits reasonably snugly around the arcuate upper ends of the elongated flotation members, thereby creating the opening 13 that is adapted to receive the neck of the wearer and the arcuate external surface 47 that creates the bullet-like end of the vest.

In operation, the user spreads apart the two elongated portions 12 and drapes the jacket around the neck. The elongated members 12 are brought together and the strap 14 is wrapped around the jacket and chest of the wearer and buckled. The strap is adjustable so that it can be snugly attached to any size of torso. If the wearer should fall unconscious in the water in a face-down attitude, the higher specific gravity body 11 will flop around to the underside of the vest leaving the vest on top of the water and the wearer's face exposed above the vest. The wearer's head is cradled very snugly against the upper end of the vest and is thus kept from lolling from side to side under the action of waves.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

I claim:

1. A buoyant vest comprising:

a pair of elongated foam members disposed side-by-side and having edges facing each other, each member having a substantially semicircular recess formed in one end portion of said facing edges, said recesses facing each other to form an opening to extend around the neck of the wearer, a V-shaped sheath of material encasing said foam members with said recessed ends of said foam members being in abutment, and means for securing the ends of said members, remote from said recesses, to the body of the wearer.

2. A buoyant vest as in claim 1 in which the outer surface of each member opposite its recess is arcuate, whereby the outer surface of said vest surrounding said recesses is semicircular.

3. A buoyant vest as in claim 1 in which said securing means is a single belt having a fastener at one end.

4. A buoyant vest as in claim 1 in which said sheath is a single sheet of fabric formed into a tube to receive said elongated members.

* * * * *